United States Patent [19]

Wesley, John G.

[11] Patent Number: 4,636,278

[45] Date of Patent: Jan. 13, 1987

[54] APPARATUS FOR LABELING NESTING TYPE BUCKETS

[75] Inventor: John G. Wesley, Oak Brook, Ill.

[73] Assignee: Labelette Company, Forest Park, Ill.

[21] Appl. No.: 811,373

[22] Filed: Dec. 20, 1985

[51] Int. Cl.[4] ..... B65C 3/12; B65C 9/06; B65C 9/30

[52] U.S. Cl. ..... 156/446; 156/475; 156/486; 156/DIG. 11; 156/DIG. 27; 156/DIG. 35; 156/DIG. 39

[58] Field of Search ..... 156/446, 475, 486, 556, 156/DIG. 11, DIG. 27, DIG. 35, DIG. 39

[56] References Cited

U.S. PATENT DOCUMENTS

| | | | |
|---|---|---|---|
| 3,278,359 | 10/1966 | Wesley | 156/351 |
| 3,625,797 | 12/1971 | Wesley | 156/446 |
| 4,162,182 | 7/1979 | Wesley | 156/487 |
| 4,239,570 | 12/1980 | Kerwin | 156/475 |
| 4,591,403 | 5/1986 | Von-Meyer | 156/446 |

*Primary Examiner*—Michael Wityshyn
*Attorney, Agent, or Firm*—Mann, McWilliams, Zummer & Sweeney

[57] ABSTRACT

An improvement in labeling machines of the type disclosed in Wesley U.S. Pat. No. 3,278,359 in which provision is made for labeling nesting type buckets or pails in which the pair of rotating support rollers that form the cradle on which the bucket or pail is rotatably mounted for application of a label thereto is modified by providing the non-adjustable support roller that overlies the label feed guide with an index roller seat in which rides the pail rim at the pail closed end; the other laterally adjustable support roller has a similar index roller seat that cooperates with the index roller seat of the first mentioned roller to cradle the pail closed end, and a positioning disc is disposed adjacent the other end of the adjustable support roller against which the pail external surface rides when the pail is supported for labeling purposes by the support rollers, with such positioning disc being proportioned in external diameter relative to the amount of circumferential wrap the label to be applied to the pail is to have as to the pail external surface, to dispose the pail side wall surface in substantial flush relation with the said label outfeed angle. The pail when applied to the roller cradle involved is resiliently held against the support rollers thereof by a roller rectractably engaged with the inside of the pail, whereby the pail rotates with the support rollers of the supporting cradle therefor, for application of the label thereto.

10 Claims, 7 Drawing Figures

APPARATUS FOR LABELING NESTING TYPE BUCKETS

This invention relates to the semi-automatic application of labels to nesting type containers, and more particularly, to the labeling of nesting type pails or buckets, with the invention involving improvement of the machine disclosed in the Applicant's U.S. Pat. No. 3,278,359, granted Dec. 7, 1971.

The labeling machine of the above identified patent provides an arrangement for conveniently applying labels to round containers in which the containers are one by one laid sidewise on a pair of rotating support rollers forming the support cradle or bed for the container being labeled, and the label for the container that is being processed is separated from a supply of labels in the hopper, fed past a glue station where glue is applied thereto, and guided into cooperation with the container in timed sequence to the rotation of the container, so that the label becomes affixed to the round sidewall of the container in the manner desired in accordance with the invention of that patent.

Round containers of the type represented by nesting pails or buckets have become commonly available for packaging liquid materials, in place of ordinary cylindrical containers, as the sidewalls of the nesting type containers are tapered or frusto-conical in configuration for nesting purposes, with the larger diameter at or adjacent the container open end, as distinguished from the container closed end, so that, when empty, such containers can be nested together with an inner container seated within the same size outer container throughout the resulting stacked group of such nested containers, for ease of packaging and shipping. The ordinary cylindrical container will not nest in stacking relation into containers of the same size because such containers of the same size do not fit one within another in the manner of nesting containers.

However, the resulting taper of the nesting type pail or bucket external wall surface presents a problem of labeling such containers by machine labeling as the tapered nature of the pail or bucket as seated on the rotating support rollers for labeling purposes disposes the container side wall at a tilted relation relative to the movement path of the label being applied to the container such that the label as applied to the container external wall surface in its finalized position is not in the desired straight across relation relative to the height of the bucket pail, but rather will be in slanted or skewed position. The frusto-conical configuration of the bucket or pail external wall surface presents a significant positioning problem relative to the movement path of the labels through the machine to the labeling station, and particularly at the desired location where the label is to initially adhere to the container. This problem would obtain even if the pail or bucket itself is journalled for rotational movement about its central axis, something that is not very practical in view of the structural nature of the common nesting pail or bucket and the bail type handle with which it is equipped.

Further, the bail type handle with which these containers are commonly equipped is intended to be freely swingable about its pivotal connections to the bucket or pail involved, which, when the container is rotated about its central axis, tends to swing and interfere with the rolling of the container for label purposes, where the container is supported on support rollers of the type disclosed in said patent, by coming between the container and the labeling machine support rollers that are suppose to turn the container, should the handle swing against the side of the container during the course of the labeling procedure.

A principal object of the present invention is to provide a labeling apparatus or machine that will label nesting buckets or pails equipped with the usual bail type handle, and provide for labeling of same in varient sizes, for instance in the form of one to five gallon containers.

Another principal object of the invention is to provide a labeling machine for labeling nesting containers that provides for setting the machine for a particular size container to dispose the side wall of the container at the desired flush relation to the label outfeed angle at the labeling station, with the container so disposed being skewed relative to the support rollers roughly in proportion to the degree of wrap that the label is to have about the container side wall external surfacing, whereby the labels may be applied to such containers of the same size semi-automatically and be free of skewed position relative to the container.

Another important object of the invention is to arrange labeling machines of the type disclosed in the Applicant's disclosed U.S. Pat. No. 3,278,359 for labeling buckets or pails of the nesting type that provides for semi-automatic processing of the containers involved, arranging the supporting rollers on which the container is to be placed for rotating same to define a positive and definite canted socket forming cradle for the container to be placed in during the course of labeling a number of the same size containers mass production style, with firm hold down being applied to the container during the labeling procedure that is readily released when labeling of one such container is completed to replace same with the following container to be labeled.

Still other objects of the invention are to make available for labeling buckets and pails of the nesting type all of the advantages made available by the Applicant's said U.S. Pat. No. 3,278,359 for labeling ordinary round containers, and to do so by improvements that are economical of manufacture, convenient to apply and use, and long lived in operation.

In accordance with the invention, for a given size pail or bucket of the nesting type, for instance, the five gallon size, the two rotating, multi hub or disc rollers of the container roller support cradle involved are modified by applying to like ends of both said rollers an index roller seat in which is to ride the pail rim at the pail closed end, and as to the cradle laterally adjustable support roller adjacent the other end of same a positioning disc is provided which is to engage the pail external surfacing short of the pail handle mounting lugs and have a rim portion on which the pail side surface rides that has an external diameter which is proportioned relative to the circumferential wrap the label to be applied to the pail is to have that will dispose the pail side wall surface in question at substantially flush relation with the label outfeed angle at the non adjustable roller. The labeling machine is also provided with a hold down roll arrangement that engages the inside of the pail to resiliently hold the pail in the socket defined by the roller support cradle during the labeling procedure, with provision being made for ready release of the pail that has been labeled and quick replacement of the next pail of the same size to be similarly labeled.

Other objects, uses, and advantages will be obvious or become apparent from a consideration of the following detailed description and the application drawings.

In the drawings:

FIG. 1 is a diagrammatic front elevational view of a labeling machine of the type disclosed in the Applicant's said patent, diagrammatically illustrating a typical five gallon nesting type bucket cradled by the machine and in the process of being labeled, with the basic label feeding mechanisms of said patent and other conventional structure being omitted, and showing the pail hold down device in two positions of operation;

Figure 1:
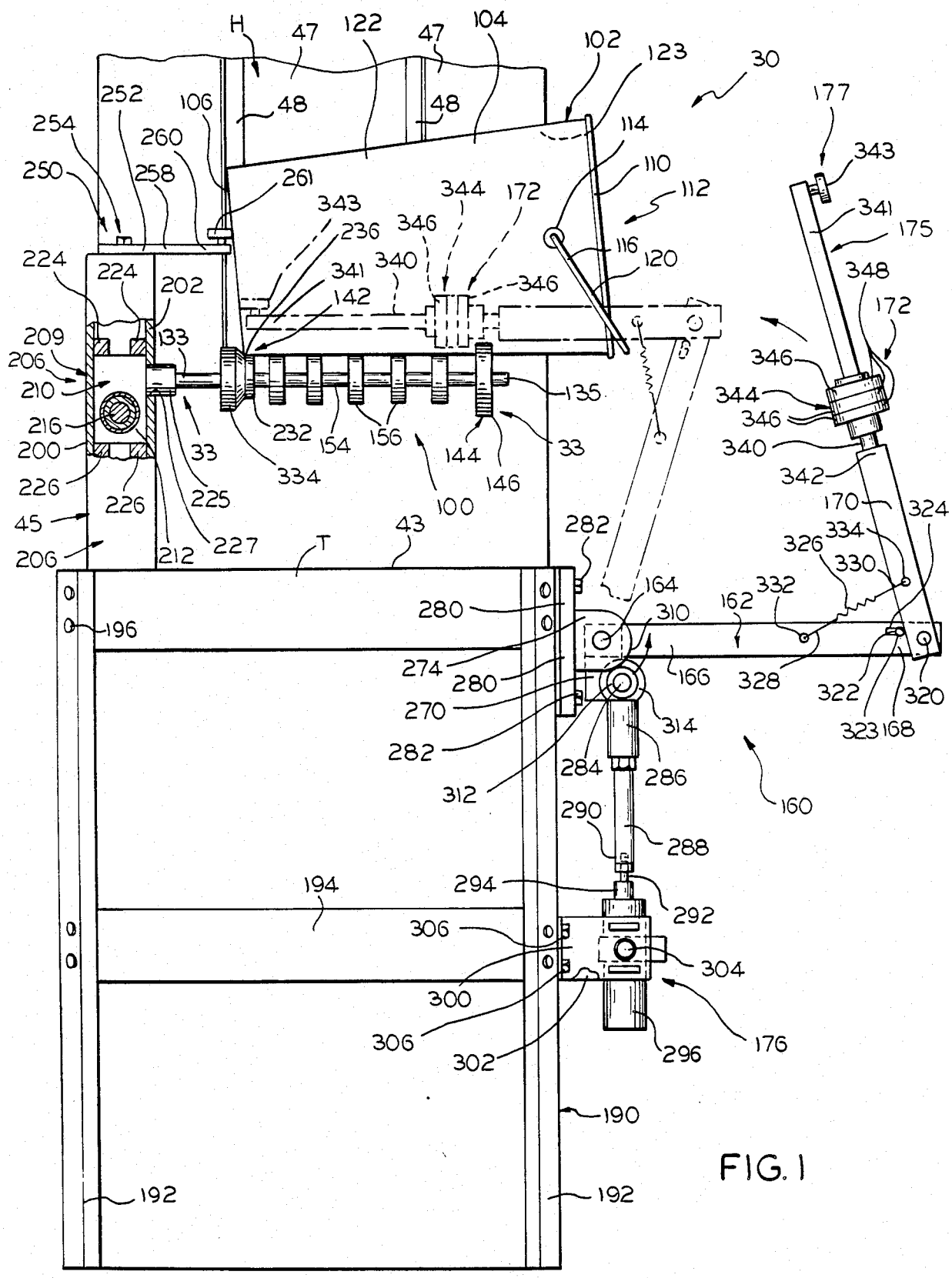
Figure 4:
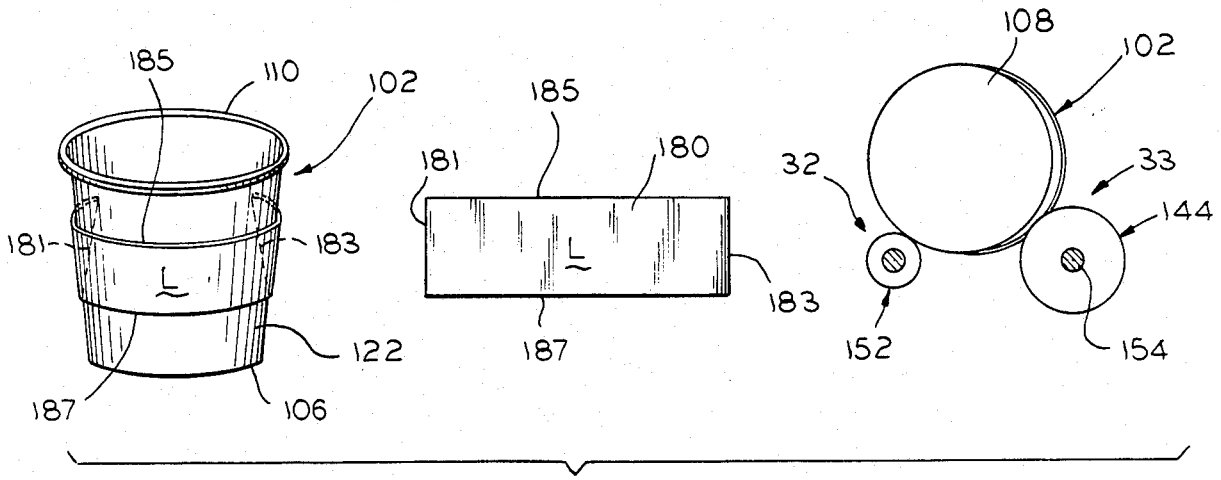
Figure 5:
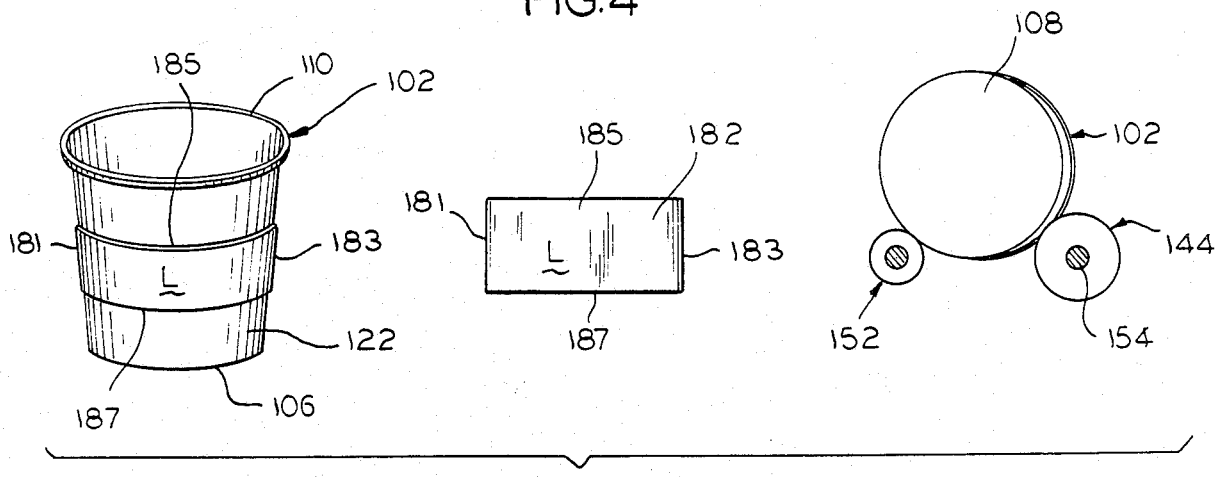
Figure 6:
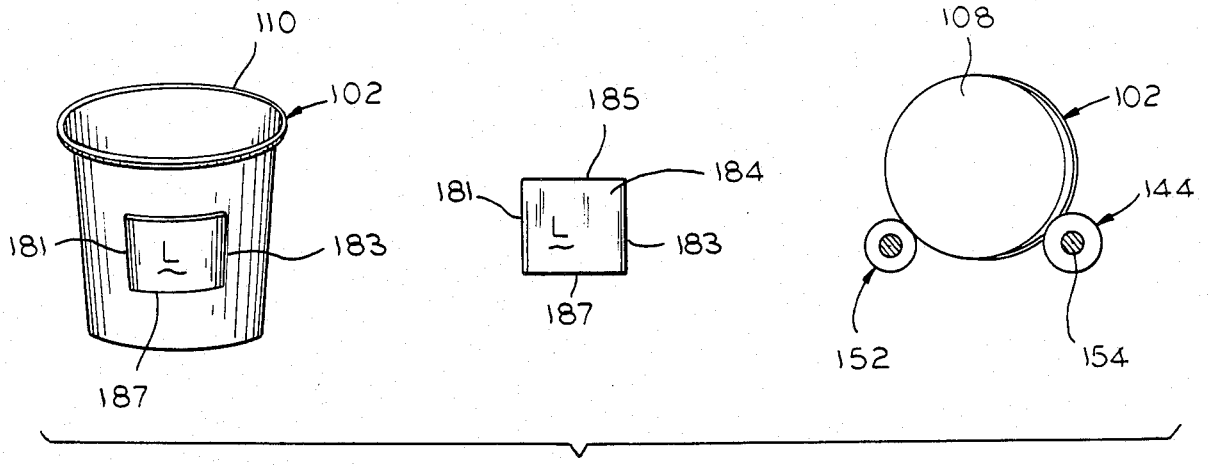
Figure 7:
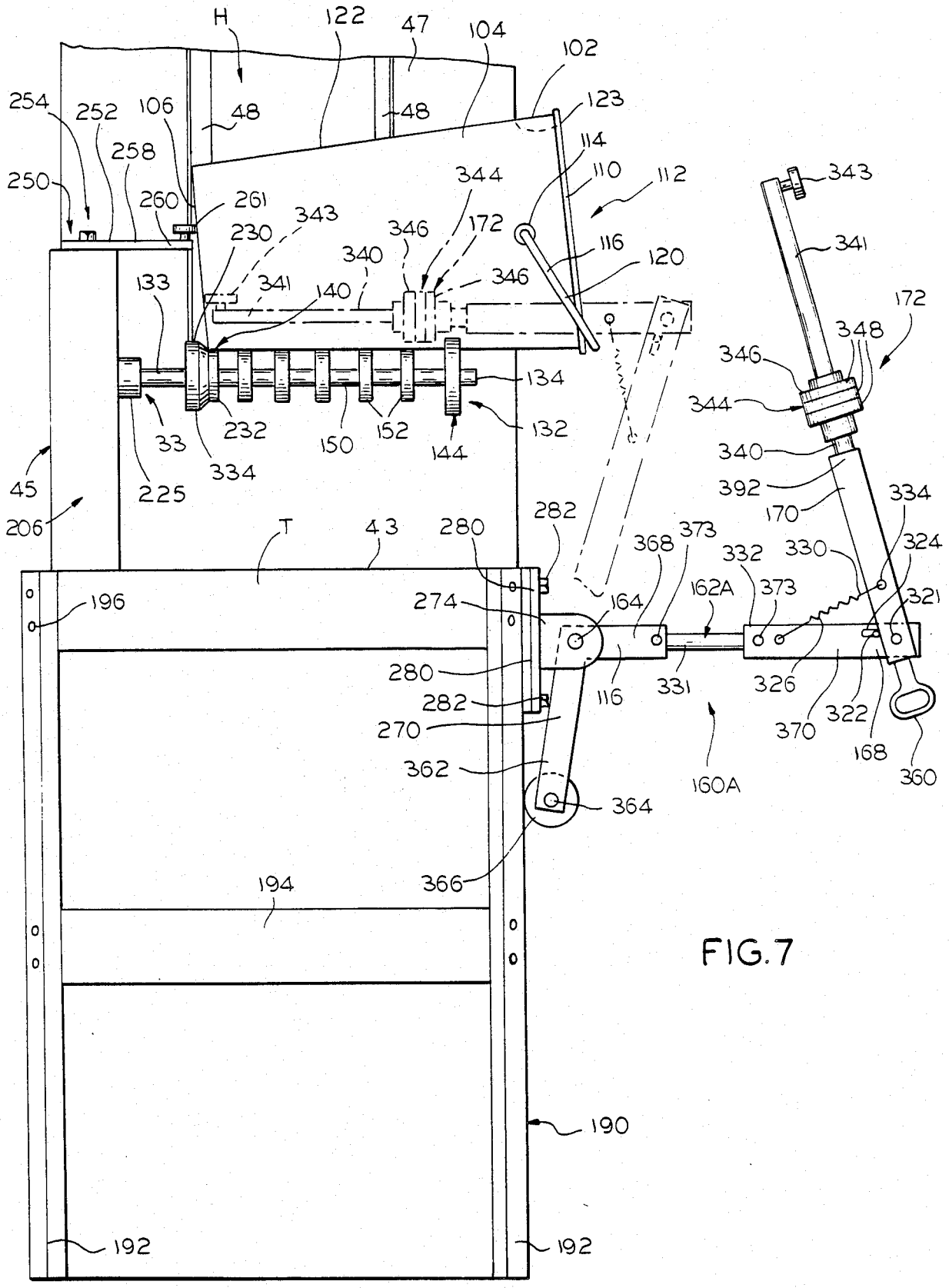

FIGS. 4, 5 and 6 are each composite views illustrating the relation of the arrangement of the pail size accommodating support cradle roller that is opposite the cradle roller that overlies the outfeed position of the label to be applied to the container, and the pail canting disc arrangement of such adjustable roller, relative to the degree of wrap the label to be applied to the container is to have about the container side wall surfacing when the label is in place; and FIG. 7 is similar to FIG. 1, but illustrates a modified embodiment having a hand operated pail hold down roller arrangement.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 3:
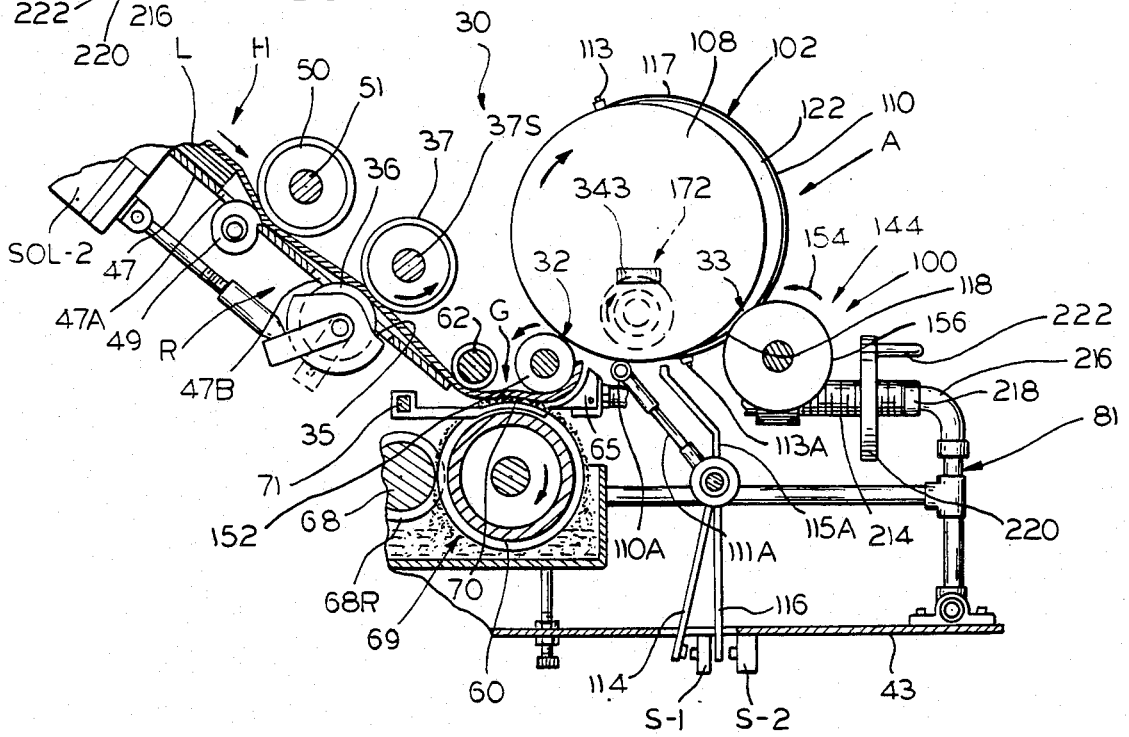
FIG. 3 is a vertical sectional view taken from the front to the rear of the machine with some of the major components of the machine of the Applicant's said patent being illustrated in conjunction with the improvements of this invention, the view being approximately along line 3—3 of FIG. 2.

Referring first to FIG. 3, which discloses a number of the basic components of the machine of the Applicant's said patent (the disclosure of which is hereby incorporated herein by this reference), it will be seen that the labeling machine 30 generally comprises an inclined adjustable hopper H in which a supply of labels L are supported for separating and feeding one by one past a glue station G, and after glue has been applied thereto, are guided into cooperation with the rotating container that has been disposed at the labeling station A. In accordance with the disclosure of said patent, round containers are applied to a pair of constantly driven support rollers 32 and 33 which form a support cradle for the container being labeled, with the roller 32 being located on a fixed axis adjacent to and above the output side of glue station G, while the other support roller 33 is mounted for adjustment toward and away from the roller 32 so that containers of different diameters may be supported in the desired support relation by the two rollers 32 and 33.

As described in said patent, the labels L are fed one at a time from a hopper H to a register station R that is defined in part by a retractable register stop 35, when the leading edge of the label L is engaged with the stop 35, such leading edge is located between a pair of constantly driven normally separated feed rollers 36 and 37 so that upon withdrawal of the stop 35 and on engagement therewith of the two feed rollers 36 and 37, the label L that has been advanced to the register station R is withdrawn and advanced to and through the glue applying station G for application to the container.

The hopper H is provided with a sloping bottom plate 47 that slopes downwardly and has a pair of adjustable side guides (FIG. 1) to provide the hopper H in which the stack of labels L are positioned. Feed roller 36 and register stop 35 project through an opening 47B in the plate 47, and the plate 47 extends beyond or to the right of the opposed feed rollers 36 and 37 (as viewed in FIG. 3) to a point just above the left hand side of the relatively large glue coating roller 60 that forms a part of glue coater 61 that is located just beneath and somewhat to the left of the support roller 32 (as shown in FIG. 3). As a label L is advanced by the feed rollers 36 and 37 from a register position, such label moves along the plate 47 and beneath the guiding and feeding roller 62 and thence into engagement with the coating roller 60 that is constantly rotating, from which it moves into label applying position beneath the support roller 32, where the leading edge of the label strikes a series of spaced guide plates 65 that direct the leading edge of the label outwardly from between the guide plates 65 and the support roller 32 into a label outfeed position where the label is intended to engage the container external wall surfacing in the manner disclosed in said patent.

Other related parts of the machine of the Applicant's said patent are shown in FIG. 3 with identical reference numerals being applied thereto, it being understood that reference may be had to the Applicant's said patent for a complete description of the component parts involved and their operation.

In accordance with the present invention, the machine 30 is provided with a support cradle 100 which comprises the support rollers 32 and 33 modified in accordance with the invention to receive and provide a socket type support for bucket or pail 102 that is diagrammatically illustrated in the drawings and is intended to represent any conventional nesting type of container that comprises the usual frusto-conical side wall 104, terminating at rim portion 106 at its bottom panel 108 and rim portion 110 at its open end 112. Such pails or buckets may be formed from either a suitable plastic or metallic material, and in addition to the frusto-conical configuration of the container side wall 104, they are characterized by a pair of lugs 113 and 113A that are disposed in opposed relation adjacent the open end 112 of the container for mounting opposite ends 117 and 118 of conventional bail handle 120, and with the varient ways known to the art to achieve this end whereby the handle 120 is swingably mounted on a container 102.

The container 102 thus defines external side wall surfacing 122 that below the lugs 113 and 113A is ordinarily frusto-conical in configuration with the larger end adjacent the open end 112 of the container and the smaller end at the rim portion 106 of the container. It is this surfacing 122 that is to bear the label to be applied to the container 102, and it is a major objective of the present invention to insure that the invention applies the label to the container 102 so that it extends basically centered and transverse crosswise of the container, about the surfacing 122, and relative to the longitudinal central axis of the container 102, and is not skewed or slanted with respect thereto; the left hand views of FIGS. 4–6 show in diagram containers 102 with quadrilateral labels of varient wrap proportion applied thereto, in accordance with the present invention, which does involve a slight amount of "flag" positioning of the labels on the container external surfacing 122 since labels of quadrilateral (basically rectangular) configuration are to be applied to a frusto-conical convexly curved surfacing (122) of the container 120.

In accordance with the improvement of this invention, the rollers 32 and 33 are rotatably mounted, and this may be done in the manner disclosed in said patent, they may be cantilever mounted from like ends 132 and 133 thereof, as illustrated, so that their other ends 134 and 135 are in projecting relation free of journalling in the machine 30.

Further, the roller 32 is provided with, adjacent its end 132, an indexing roller seat 140 (see FIG. 2), while the roller 33 adjacent its end 133 is provided with a comparable indexing roller seat 142. The lower or bottom rim 106 of the container 102 in being applied to the cradle 100 is to be applied to the respective seats 140 and 142.

Further, the roller 33 adjacent its end 135 is provided with a container positioning or canting disc or hub 144 having a rim portion 146, against which the side wall 104 of the container 102 to be labeled rides, which rim portion 146 is proportioned in diameter to dispose the external side wall surface 122 of the container 102 at the location of the roller 32 in substantially flush relation with the outfeed angle of the label that is to be fed from the label hopper H, for application of such label to the container side wall surfacing 122, when the container 102 is supported for labeling purposes in the cradle 100.

Figure 2:
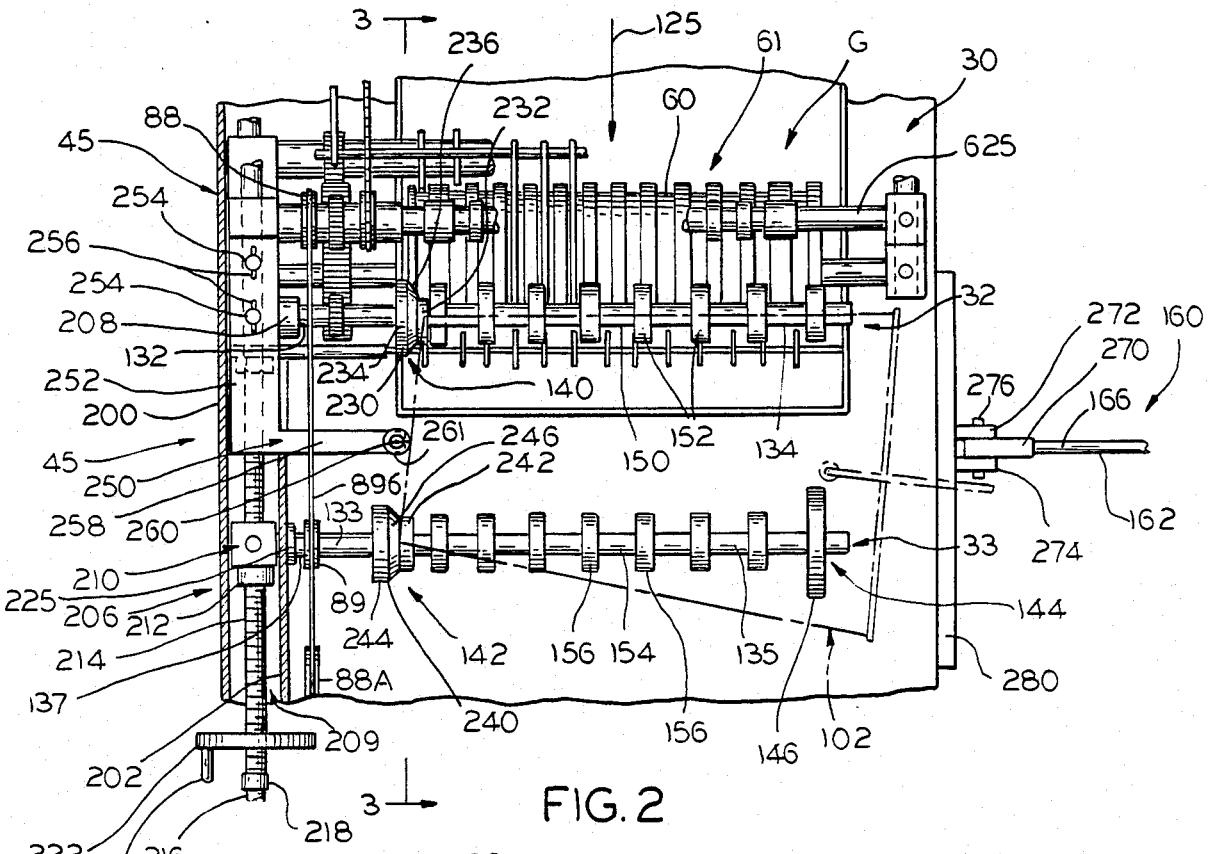
FIG. 2 is a top plan view of the roller support cradle shown in FIG. 1 illustrating both the support rollers of the cradle in solid lines, and the bucket as supported by same in phantom.

The roller 32 as suggested by said patent comprises shaft 150, which, as shown, may be cantilever mounted adjacent its end 132 in any suitable manner and driven in a manner suggested by said patent (compare FIG. 2 of this application to FIG. 6 of said patent). Shaft 150 has a plurality of discs or hubs 152 affixed thereto that are of the same diameter, on which the container side walls ride, when the container 102 is riding in proper labeling relation on cradle 100.

The roller 33, on the other hand, also comprises a shaft 154 that may be likewise cantilever mounted at its corresponding end 133, and has affixed thereto discs or hubs 156 of equal diameter that are similar to the discs or hubs 152, but which play no part in the present invention (though serving the purpose disclosed in said patent, since the container canting disc 144 when used for purposes of the present invention spaces the external side wall surface 122 of container 102 from the respective discs or hubs 156 to dispose the container 102 so that, at the location of the roller 32, such container wall surface is in substantially flush relation with the outfeed angle of the label to be applied thereto, as described heteinbefore.

Further in accordance with the invention, when the container 102 is placed on the support cradle 100, the container 102 is held in place against the socket defined by the cradle 100 by a mechanically actuated, retractable hold down mechanism or device 160 of FIG. 1, or alternate device 160A of FIG. 7. Device 160 comprises crank arm 162 pivotally mounted as at 164 adjacent one end 166 of same and mounting adjacent the other end 168 of same hold down member 170 equipped with a hold down roller device 172 that is adapted to engage the inside surfacing of the container 102 through its open end 112 when crank arm 162 is moved from its retracted full line position of FIG. 1 to its broken line extended position of FIG. 1 by actuating mechanism or device 176. Hold down member 170 is articulated to crank arm 162 such that as crank arm 162 is swung to its operative extended phantom position of FIG. 1, roller device 172 is downwardly biased, resiliently, against the lower portion of the inside of the container 102, as container sits in the socket defined by cradle 100, with the roller device 172 rotating in response to the rotation of the container 102 that is induced by its support by the rotating rollers 32 and 33. Hold down member 170 includes adjustable arm 175 equipped with pail bottom engaging roller 177.

The proportioning of the diameter of the container canting disc or hub 144 is diagrammatically illustrated in FIGS. 4, 5 and 6 with regard to the amount of wrap the particular label L is to have about the external side wall surfacing 122 of a container 102 to be processed. The various sizes of labels L 180, 182 and 184 shown in these drawing Figures each have end edges 181 and 183, and side edges 185 and 187.

Where the label is to have a wrap of approximately three-quarters of the circumference of the external wall surfacing 122 or thereabout (label 180), the canting disc 144, and specifically its rim 146, should have a diameter that will cant the container 102 such that the portion of its side wall surfacing 122 disposed along roller 32 will be substantially flush with and thus transversely of the outfeed angle or direction of movement 125 of the label to be applied thereto, in which case the container 102 will be disposed at a relatively large acute angle relative to shaft 154, as indicated in FIG. 4.

Where the label for the same size container is proportioned to have a wrap about the container that extends approximately over one-half the circumference of the side wall 122, as illustrated by the label 182 of FIG. 4, the diameter of the rim 146 of disc 140 is proportionally reduced a corresponding amount to provide the flush relationship with the label outfeed angle that has been indicated, whereby the container has the reduced angulation relative to shaft 154 that is indicated in FIG. 5.

Where the label, as represented by the label 184 of FIG. 6, is to have a wrap approximating one-fourth the circumference of the container external wall 122, the disc 144, and specifically its rim 146 may have a diameter of corresponding less amount, and may in practice have a diameter the same as or somewhat larger than the external diameters of the hubs or discs 150 and 152, to provide the indicated flush relationship with the label outfeed angle that has been indicated, whereby the container has the further reduced angulation relative to shaft 15 that is indicated by FIG. 6.

SPECIFIC DESCRIPTION

Referring again to the diagrammatic showing of FIG. 3, the label separating means involved is of the top feed type, and has an adjustable but normally stationary rubber retard roller 49 mounted on an adjustable axis at an opening 47A in plate 47. Above the retard roller 49 and on an axis parallel thereto are one or more separating rollers 50 that are fixed on a freely adjustable supporting shaft 51 (which is supported and driven in the manner shown and described in said patent), which includes suitable gearing actuated by the swing arm 54, shown in said patent, being moved to shift a rubber roll into engagement with a constantly driven knurlled roll fixed to the shaft 37S and which carries feed rolls 37, this being done by the operation of a solenoid SOL-1 provided for this purpose as disclosed in said patent. As is also disclosed in said patent, a photoelectric unit may be employed to detect when a label L being advanced has reached the register position.

The machine 30 comprises suitable frame 190 arranged to provide a relatively rigid supporting base or table T for supporting the basic components of the machine including a suitable drive motor, speed reducer therefor, etc., as disclosed in said patent.

The table T is only diagrammatically illustrated as it may be of any suitable type, but as disclosed in said patent it defines top 43 upon which the main portions of the machine 30 are mounted. In the form shown, the table 43 is defined by suitable frame 190 including legs 192 and brace members 194 secured together by appropriate connectors 196 to define a generally quadrilateral top 43 on which the components of the machine 30 are mounted including the aforedescribed hopper H, its floor 47, and the various components shown in FIGS. 2 and 3, as arranged in accordance with the skill of the art, with reference to the disclosure of said U.S. Pat. No. 3,278,359 for guidance.

In accordance with the illustrated embodiments of the present invention, the support rollers 32 and 33 that form the supporting rotation generating cradle 100 for the container 104 are cantilever mounted from their respective ends 132 and 133, and thus machine 30 has a special side frame structure 45 along one side of same in which the rollers 32 and 33 are operably mounted in accordance with the objects of the present invention.

In this connection, the machine 30 is illustrated to have a single tubular support frame 81 mounted on table 43 adjacent the side frame structure 45, with it being understood that the other support frame 81 on the underside of the machine, as disclosed in said patent, is foreshortened as needed to avoid interference with the components shown in the appended drawings, in the illustrated embodiment. However, the basic rollers 32 and 33 may be mounted substantially as shown in said patent, as such, and the other components herein disclosed modified accordingly.

Side wall structure 45 may be of any suitable type, that shown comprising spaced apart vertical plates 200 and 202 (see FIG. 1) fixed to table T in vertically disposed, spaced relation, so as to define composite wall structure 206 in which shafts 150 and 154 are suitably journalled at their respective ends 132 and 133 cantilever fashion. For instance, suitable bearing device 208 is suitably mounted in wall structure 206 and is fixed in its mounted position and suitably journals the end 132 of shaft 150. Wall structure 206 is formed to define way 209 that is horizontally disposed and in the form illustrated receives suitable bearing structure 210 that journals the end 133 of shaft 154 and includes a nut portion 212 which threadedly receives externally threaded sleeve 214 that is rotatably mounted on the horizontal portion 216 of the frame 81 that extends through the wall structure 206, which sleeve 214 is held against movement longitudinally of the frame portion 216 between suitable stops, one of which is shown at 218 in FIG. 2. For the purpose of shifting roller 33 toward and away from roller 32, the sleeve 214 may have affixed to same disc 222 equipped with handle 220 for rotating the sleeve 214 in the direction needed to move the roller 33 toward and away from the roller 32, as desired for a particular bucket or pail width size to be handled.

In the form shown, way 209 is further defined by spaced pairs of upper and lower horizontally disposed guide bars 224 and 226 (see FIG. 1) suitably affixed to the respective plates 200 and 202, as by employing welding, with the bearing structure 210 being guided at its upper and lower portions by the respective bars 224 and 226 in the manner suggested in FIG. 1. Sleeve portion 225 of bearing 210 rides in elongate slot 227 formed in plate 202 for the length of way 209.

As already mentioned, the shaft 150 of the roller 132 may be equipped with the discs or hubs 152 of the type disclosed in said patent. In accordance with this invention, the indexing roller seat 140 comprises special disc member 230 defining stepped diameter hub portions 232 and 234, with the smaller diameter hub portion 232 being separated from the larger diameter hub portion 234 by frusto-conical portion 236.

As to the indexing roller seat 142, it is of the same structural arrangement as seat 140, and thus comprises disc member 240 of stepped diameter configuration defining smaller hub portion 242 and larger hub portion 244 separated by frusto-conical portion 246. The hubs or discs 156 of shaft 33 are the same as discs or hubs 152. The canting disc 144 is applied at the projecting end 135 of the shaft 154.

The hubs or discs 144, 152, 156, 230 and 240 may be formed from brass or cadminum plated steel, and they also could be formed from a suitable rubber or equivalent plastic material. They are suitably affixed to the respective shafts 150 and 154, as by employing conventional set screw arrangements (not shown) that permit ready release and rearrangement of the shafts 150 and 154 as may be necessary or desirable to accommodate labeling of a series of different size containers 102. When setting the machine 30 up to handle a particular size bucket or pail 102, adjustment of the canting disc 144 longitudinally of shaft 154 may be employed to insure that the bucket external surface 122 has the desired flush relation to the outfeed angle of the labels that are to be applied to the buckets or pails in question, and in such position the surface 122 is in substantial riding engagement with the hubs 152 of roller 32 (that are within the top to bottom dimension of the pail size being labeled).

Operably associated with the labeling station A in accordance with the present invention is the pail or bucket indexing device 250 that comprises in the form shown plate 252 releasably secured in place on top of the wall structure 206, against movement longitudinally of the way 209, by suitable screw devices 254 applied to the wall structure 206 through elongated plate openings 256. The plate 252 includes indexing arm 258, the end 260 of which journals roller 261 which serves as a stop type external guide for assisting in the positioning and holding the container 102 in the socket defined by the rollers 32 and 33, and specifically, on the indexing roller seats 140 and 142, the canting disc 144, and the supporting discs or hubs 156. In use, the parts are arranged and located such that the closed end 108 of the container 102 is spaced somewhat from the guide arm end 260 when the container 102 is rotated for rotating purposes.

The hold down device 160 comprises the swing arm 162 having its end 166 fixed, as by welding, to pivot block 270 that is pivoted between spaced lugs 272 and 274 by pivot pin 276. Lugs 272 and 274 are suitably fixed to cross bar 280 that is suitably fixed to frame 190, as by employing bolts 282.

The pivot block 270 has pivoted to same by suitable pin 284 the upper end 286 of thrust link 288 that has its lower end 290 operably connected as at 292 to the piston rod 294 of pneumatic piston and cylinder device 176 defining cylinder 296 which receives the piston rod 294 and associated piston (not shown) and is connected to a suitable source of compressed air under pressure. Cylinder 296 is mounted for pivotal movement about a horizontal axis between spaced apart bracket plates 300 and 302 by suitable trunnions 304; bracket plates 300 are suitably secured in place, as by employing bolts 306.

The lugs 272 and 274 are formed with rounded edge surfaces 310 that are engaged by rollers 312 disposed on either side of the link upper end 286, and specifically its connector portion 314, that are suitably journalled on pin 284 for riding on the respective rounded surfaces 310.

The swing arm 162 at its end 168 mounts the hold down member 170 by way of pivot pin 320 pivotally connecting the two, with the end 168 of the arm 162 mounting screw and nut device 322 forming an adjustable stop 323 in elongated slot 324 to adjustably limit the pivoting movement of the hold down member 170 toward the end 166 of the swing arm 162. Suitable tension spring 326 having its ends 328 and 330 suitably connected to the swing arm 162 and hold down member 170, as indicated at 332 and 334, respectively, holds the hold down member 170 spring biased against the stop 323 of screw and nut device 322, in the retracted position of device 160, which may be adjusted positionally of slot 324 to effectively dispose hold down member 270 in the desired position of FIG. 1 when engaging buckets or pails of a specific size being labeled.

The roller device 172 comprises elongate shaft 340 adjustably received into the projecting end 342 of hold down arm 170 and having suitably journalled on same suitable ball bearing roller device 344 that in the form illustrated includes three rolling ring members 346, the rims or treads 348 of which engage the inside surfacing 123 of the container side wall 104, of the container 102 that is to be held in place against the rollers 32 and 33 during the labeling procedure. Shaft 340 may be extended from or retracted into arm 170 and held in adjusted position using conventional set screw clamp devices (not shown) at the desired operating length to have the pail engaging relationship indicated in FIG. 1 for a particular size pail or bucket being processed. Shaft 340 extends through roller device 344 and has projecting end 341 on which is suitably journaled roller 343 which serves as an internal stop guide for assisting in the positioning of the container 102 in the aforementioned socket defined by rollers 32 and 33 (see FIG. 1). Roller 343 rides on the inside surfacing of the container bottom panel 108 to bias same against the indexing roller seats 140 and 142, the canting disc 144, and the hubs 152 of roller 32, in the extended relation of hold down device 160 (shown in phantom in FIG. 1). Roller 261 is a move-limiting device that avoids the container 102 from being shifted beyond seats 140 and 142. While indexing device 250 may be elevationally disposed to be opposite roller 343, the out of alignment relation indicated is frequently required because of inward or outward projecting studs or the like that are affixed to container end 108.

As already indicated, the retracted position of the device 160 is shown in full lines in FIG. 1 and its extended operative position as indicated in the broken line showing of the same Figure. As swing arm 162 moves upwardly, the hold down arm 170 enters within the open end 112 of container 102, the roller device 344 is brought to bear against the inside surfacing 123 of the container in between the rollers 32 and 33, and rewardly of the bucket or pail beyond the canting disc 144, with the hold down member 170 articulating about pivot pin 320 in a clockwise direction relative to the swing arm 162 (in the orientation provided by the showing of FIG. 1), and roller device 343 engaging the container bottom panel 108. This swinging action is against the tension of tension spring 326, whereby spring 326 acts to bias the roller device 344 downwardly against the container inner surfacing to hold the container 102 in place on cradle 100 while labeling of same is taking place. The stop 323 is adjusted before the pail or bucket labeling run is made to set the arm 170 at the maximum angle relative to arm 162 that permits free entry of the arm 170 into the pail size being processed (in the manner indicated in FIG. 1) for each pail to be labeled of the pail size being processed.

On retraction, the device 160 moves from the extended position to the retracted position of FIG. 1.

Actuation of the device 160 may be achieved by incorporation in the operation of air cylinder device 176 suitable manual or automatic controls that extend and retract the piston rod 288 with the timing suitably coordinated with the operation of the machine 30.

In the device 160A of FIG. 7, the swing arm 162A is similar to swing arm 162, but is arranged to be manually actuated. Thus, the pneumatic device 176 is omitted, and hold down member 170 has secured to its pivoted end 321 suitable hand graspable handle 360 by which the machine operator may actuate both arms 162A and 170 by hand, to move same between the two positions indicated in FIG. 7. Arm 162A has rigid rest arm 362 suitably fixed thereto and swingable about pin 164; arm 362 at its projecting end 364 is equipped with a stop roller 366 that abuts the machine frame 190 in the full line rest position of FIG. 7. Arm 162A is also shown to comprise end segments 368 and 370 telescopingly receiving rod 371 to which suitable set screws 373 are applied to set the arm 162A at its desired length for processing a given bucket or pail size. The device 160A is otherwise the same as device 160.

In use, assuming that the machine 30 is arranged as described and illustrated, and labels of a particular size that have a particular wrap about the external surfacing 122 of a particular nesting type bucket or pail represented by the container 102, have been applied to the hopper H for application to external container 102, the disc 144 that is appropriate in internal diameter for its rim 146 for the degree of label wrap involved is applied to the shaft 154, and the roller 33 is positioned with respect to roller 32 to appropriately hold the container in the manner indicated in the drawings. The disc 144 may also be adjusted longitudinally of shaft 154 to insure that the external surface 122 of the bucket or pail size to be processed will be in riding engagement with all the hubs 152 of roller 32 for insuring the proper flush positioning that has been referred to.

Assuming that the machine 30 is otherwise set up as described in said patent to label a quantity of such containers 102, the operator initiates the operation of the machine to put into motion the various components involved, including rotation of rollers 32 and 33 that constantly rotate and in addition, rollers 36, 37, 60 and 62 that are driven at the same surface speed as support rollers 32 and 33. The operator puts the first container 102 on the cradle represented by the rollers 32 and 33, and then actuates the hold down device 160 or 160A to set the swing arm 162 (or 162A) and hold down member 170 in their extended container hold down positions. This biases the container underside against the roller 110A of the swing arm 111A (see FIG. 3) which effects closing of the switch S-1 that sets the machine 30 to feed the label L from the registered station stop toward the glue station G. As the container 102 is now rotating, when one of its lugs 113 or 113A strikes detecting arm 115A, the solenoid S-2 is actuated to withdraw the register stop and bring the rollers 36 and 37 into engagement with the label at the register to effect feeding of the label in coordination with the movement of the container 102, which by way of the specific arrangement of the rollers 32 and 33 and their adjustment as contemplated by the present invention disposes the side portion of the container 102 in substantially flush relation with the outfeed angle of the label as it is moved beyond guide plates 65. The leading end of the label is adhered to the container external wall surfacing 122, and as the container continues to rotate in the direction of the arrow of FIG. 3, the label is wound up on the container external surfacing 122 to complete adherence of same thereto.

When the container 102 has been turned sufficiently so that the label in question has been fully applied thereto, the container 102 is lifted by the operator from the machine 30 and replaced by the next container 102 to be similarly labeled.

As indicated in FIGS. 1 and 2, the rollers 32 and 33 are proportioned so that the open end of the container overhangs the projecting ends of the rollers 32 and 33 so that the canting roller 144 and the support rollers 152 ride on the external surfacing 122 of the container free of interference with the handle mounting lugs 114 and 116.

By adjusting the machine in accordance with the arrangement of said patent, and this disclosure, buckets or pails of the nesting type of varient sizes may be readily accommodated, and in a commercial embodiment of the invention, pails or buckets of the nesting type of one to five gallon size are readily handled by suitable adjustment of the machine. Other sized containers can also be handled by appropriately arranging the machine.

As the container rotates, the bail type handle is kept away from the open end of the container by the rotation of the container and the position of the hold down arm 170 so that it does not interfere with the operation of the machine.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a labeling machine for applying labels to individual round open top containers of the nesting type, said machine including a label supply hopper, a glue applying station, and a labeling station including a pair of support rollers upon which the container to be labeled may be supported and rotated, and means for feeding labels longitudinally thereof along a predetermined feed path from the hopper through the glue applying station to a label applying relation position with the container external side wall surface at the labeling station, said glue applying station including means for applying glue to the underside of the label when received from the label supply station, and said feeding means including one of said support rollers being in overlying relation to said feed path and a label feed guide mounted below said one support roller and including a guide surface concentric with the periphery of said one support roller and disposed to direct the leading end of a label to be applied to the container external side wall surface at a predetermined outfeed angle, the improvement wherein:

said support rollers include means for disposing the container external side wall surface adjacent said one roller in substantially flush relation with the out feed angle of the labels from the label feed guide when the container is received on said support rollers, said disposing means comprising an indexing roller seat mounted on each said roller adjacent one end of said rollers in concentric relation thereto and rotatable therewith for receiving the rim of the container at the closed end of same, said disposing means further comprising a disc mounted on the other roller adjacent the other end of same and proportioned in external diameter relative to the amount of circumferential wrap the label to be applied to the container external side wall surface is to have on the container external side wall surface, on which disc the container external side wall surface is to ride adjacent the container open end, whereby said container external side wall surface is disposed in said substantially flush relation and including:

means for releasably holding the container against said support rollers from inside the container and comprising a hold down arm including roller means for hold down engagement of the container inside side wall surface against said support rollers while the container is being labeled, and means for retracting said hold down arm from within said container to release same for removal from said support rollers after labeling of the container.

2. The improvement set forth in claim 1 wherein:

said support rollers are cantilever mounted from said one ends of said support rollers.

3. The improvement set forth in claim 1 wherein:

said support rollers are in substantial parallelism and their axes of rotation are in substantial coplanar relation in a horizontal plane.

4. The improvement set forth in claim 3 wherein:

said hold down arm comprises a crank arm operating in a substantially vertical plane disposed between said support rollers and having a projecting end on which said roller means thereof is mounted for reception inside the container for rolling engagement with the container inside side wall surface.

5. The improvement set forth in claim 4 wherein:

said hold down arm roller means is mounted on said crank arm for resiliently flexible lost motion movement with respect to said crank arm in said operating plane thereof.

6. The improvement set forth in claim 5 wherein:

said retracting means comprises means for swinging said crank arm between its said hold down engagement position and said retracted position thereof.

7. The improvement set forth in claim 1 including:

a fixed stop positioned adjacent said one support roller one end for indexing the container closed end relative to said indexing seat.

8. In a labeling machine for applying labels to individual pails of the nesting type equipped adjacent their open ends with a pair of opposed lugs pivotally mounting a bail type hanger, said machine comprising a frame including a label supply hopper, a glue applying station, and a labeling station including a pair of parallel support rollers journalled on said frame upon which the pail to be labeled may be supported and rotated by its external side surface being engaged therewith, and means for feeding labels longitudinally thereof along a predetermined feed path from the hopper through the glue applying station to a label applying relation position with the pail external side wall surface at the labeling station, said glue applying station including means for applying glue to the underside of the label when received from the label supply station, and said feeding means including one of said support rollers being in overlying relation to said feed path and a label feed guide mounted below said one support roller and including a guide surface concentric with the periphery of said one support roller and disposed to direct the leading end of a label to be applied to the pail external side wall surface at a predetermined out feed angle, the improvement wherein:

said support rollers include means for disposing the pail external side wall surface adjacent said one roller in substantially flush relation with the out feed angle of the label from the label feed guide when the pail is received on said support rollers, said disposing means comprising an indexing roller seat forming a part of each said roller adjacent one end of said rollers in concentric relation thereto and rotatable therewith for receiving the rim of the pail at the closed end of same, said disposing means further comprising a disc mounted on the other roller adjacent the other end of same and proportioned in external diameter relative to the amount of circumferential wrap the label to be applied to the pail external side wall surface is to have on the container side wall surface, on which disc the external side wall surfacing is to ride adjacent the pail open end, whereby said pail external side wall surface is disposed in said substantially flush relation, said roller seat and said disc being spaced apart whereby when the pail is riding on said disposing means, said disc rides on the pail external side wall surface short of the pail lugs, and including:

means for releasably holding the pail against the support roller and said disposing means roller seat and disc of said one support roller from inside the pail and comprising:

a crank arm having one end swingably mounted on said frame below said support rollers for movement in a substantially vertical plane disposed between said support rollers and substantially paralleling said support rollers, said crank arm adjacent its other end mounting a cross strut in upstanding relation thereto with resilient lost motion relative thereto and carrying a roller disposed for reception inside the pail for downwardly directed rolling engagement with the pail inside side wall surface in the extended position of said crank arm, and disposed to one side of said frame and free of the pail in the retracted position of said crank arm, and lever means for moving said crank arm between said extended and retracted positions.

9. The improvement set forth in claim 8 wherein:

said frame includes a fixed stop disposed adjacent the operating position of the pail closed end for indexing the pail closed end relative to said indexing seat.

10. The improvement set forth in claim 8 wherein:

said cross strut is proportioned lengthwise thereof to dispose said roller thereof between the pail open and closed ends in the extended position of said crank arm, and including a second roller mounted on said cross strut for engagement with the pail closed end.

* * * * *